United States Patent [19]

Gerlach et al.

[11] Patent Number: 4,568,268

[45] Date of Patent: Feb. 4, 1986

[54] BURNER WITH VARIABLE SECONDARY AIR CONTROLLER

[75] Inventors: Charles R. Gerlach, San Antonio, Tex.; Rodney T. Heath, Farmington; Alvin Dean, Bloomfield, both of N. Mex.

[73] Assignee: RADOR Limited Partnership, Farmington, N. Mex.

[21] Appl. No.: 719,593

[22] Filed: Apr. 3, 1985

Related U.S. Application Data

[63] Continuation-in-part of Ser. No. 347,393, Feb. 9, 1982, abandoned.

[51] Int. Cl.[4] ..... F23N 1/02

[52] U.S. Cl. ..... 431/90

[58] Field of Search ..... 431/90

[56] References Cited

U.S. PATENT DOCUMENTS 4,396,371 8/1983 Lorenz et al. ..... 431/90

*Primary Examiner*—Carroll B. Dority, Jr.

*Attorney, Agent, or Firm*—Fulbright & Jaworski

[57] ABSTRACT

A housing having an atmospheric air inlet with a baffle separating the housing into a primary air inlet chamber and a combustion chamber. A main burner and a pilot burner extend through the baffle with their metering devices positioned in the primary air chamber and their burner tips positioned in the combustion chamber. A variable air controller for controlling secondary air includes a valve positioned between ambient air and the combustion chamber and controls the amount of secondary air in response to the fuel pressure.

5 Claims, 4 Drawing Figures

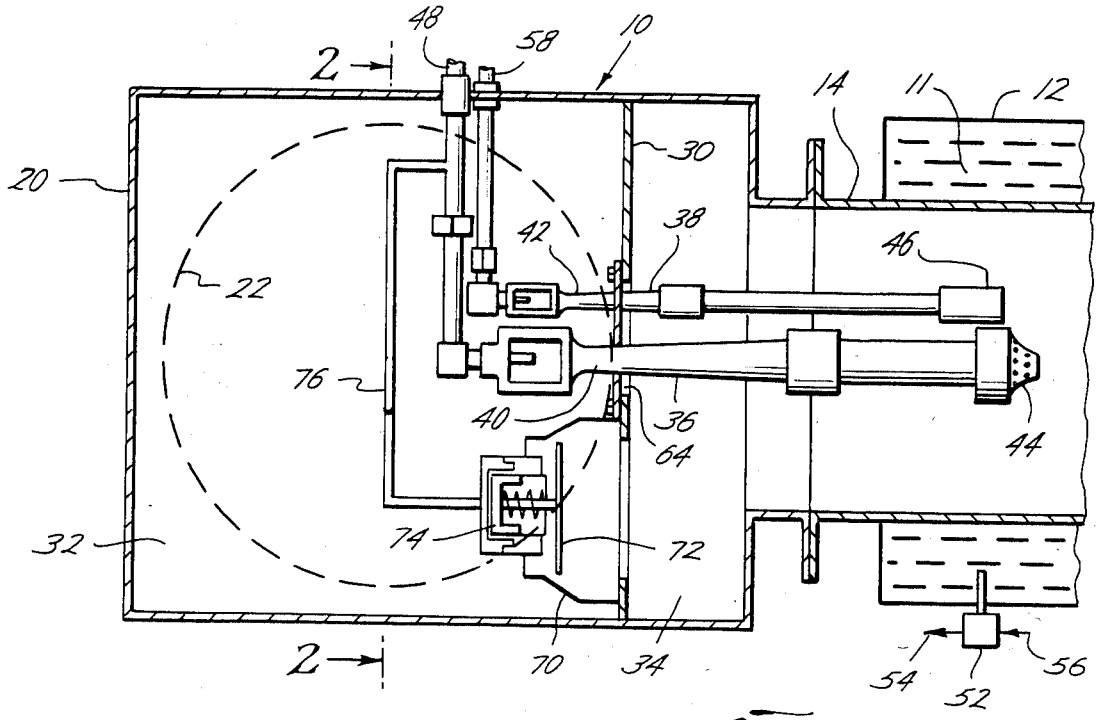
Fig. 1
Fig. 2
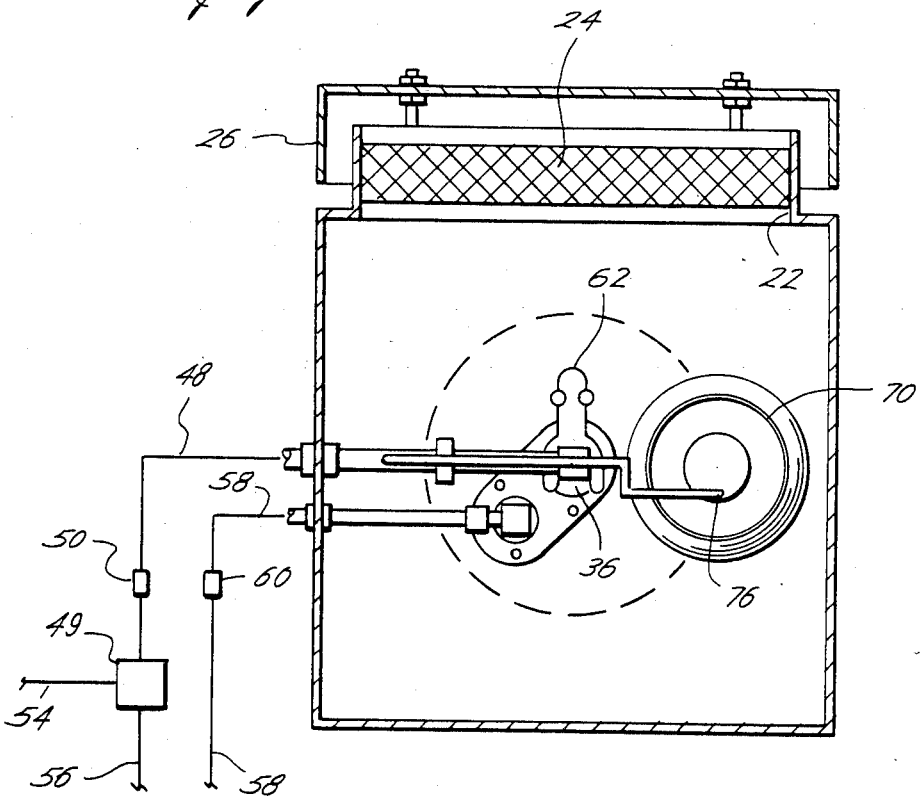

BURNER WITH VARIABLE SECONDARY AIR CONTROLLER

CROSS-REFERENCE TO RELATED APPLICATIONS

This application is a continuation in part of application Ser. No. 06/347,393, filed Feb. 9, 1982, now abandoned, entitled Burner With Variable Air Controller.

BACKGROUND OF THE INVENTION

The present invention pertains to the control of the air supply to a burner such as a natural gas burner used in the production and/or processing of liquid and gaseous petroleum products. The amount of fuel, such as natural gas, consumed represents a reduction in the quantity available for sale and other uses. However, the typical burner with no variable air controller utilizes an excessive amount of air and excess oxygen which is inefficient and wasteful since unnecessary air is being heated.

The variable air controller described in our copending patent application, Ser. No. 06/347,393, is directed to controlling the total air flowing into the burner housing as a function of the pressure of the natural gas supplied to the burner. The structure of that application controls the amount of air to provide the desired 3% to 5% excess oxygen and achieved a significant savings of fuel gas. That invention was successful on units having small fire tubes, that is, four to eight inches, and particularly on units with a throttling temperature control. However, on larger units, particularly where the main burner is snapped on and off, irregular burning and flame-outs of the main burner and pilot burner have been experienced. Also, it appears that an interaction of the combustion process at the burner tip was caused by pressure pulsations, that is, system acoustical phenomena. The flame under certain conditions can be caused to pulsate in response to force pressure pulsations and can actually couple with the acoustical phenomena of the tube system to form a dynamically unstable or self-resonant system. Also, when the air controller was substantially closed, the oxygen in the system was quickly depleted causing the flame to more readily go unstable and/or to couple with the system acoustical phenomena.

The present invention is directed to providing a primary supply of air which is always available, but to use a variable air controller for controlling the overall excess oxygen by controlling only a secondary air flow. The present invention has the following advantages:

(1) It allows regulation of the air fuel ratio over the firing range for 3% to 5% of excess air, (2) It reduces irregular burning and flame-out of the pilot when the main burner is not firing, (3) It allows the use of a smaller variable air controller since only the secondary air is controlled and this increases the accuracy of the control, (4) It reduces flame-out of the pilot and main burner when the burner is turned on, (5) It provides the means of helping to dynamically decouple the combustion process and the fire tube/-stack acoustics, and (6) It eliminates sweating in the burner housing.

SUMMARY

The present invention is directed to a heating apparatus having a housing with an atmospheric air inlet. A baffle in the housing separates the housing into first and second chambers with the first chamber forming a primary air inlet chamber and the second chamber forming a combustion chamber. A main burner and a pilot burner extend through the baffle. The main burner and the pilot burner each includes a metering device for mixing air and fuel and the metering devices are positioned in the air inlet chamber. The main burner and the pilot burner each includes a burner tip which is positioned in the combustion chamber. Therefore, primary air enters the combustion chamber and is mixed with the fuel by the metering devices and provides a flame at the burners which is more stable. In addition, a variable air controller is provided for controlling secondary air for optimizing the air fuel ratio. The controller includes a valve positioned between ambient air and the combustion chamber, and fuel pressure responsive means is connected to the valve for controlling the amount of secondary air in response to the fuel pressure.

Still a further object of the present invention is wherein the valve controls the amount of secondary air linearly in response to the fuel pressure for controlling the overall excess oxygen in the burner to approximately 3% to 5%.

Yet a further object of the present invention is wherein the valve of the variable air controller is positioned between the first and second chambers.

Yet a still further object of the present invention is wherein the metering devices are venturis.

Still a further object of the present invention is wherein the barrier includes an adjustable air opening.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is an elevational, schematic view of a typical burner heating system utilizing the present invention, FIG. 2 is a cross-sectional view taken along the line 2—2 of FIG. 1.

DESCRIPTION OF THE PREFERRED EMBODIMENTS

Figure 3:
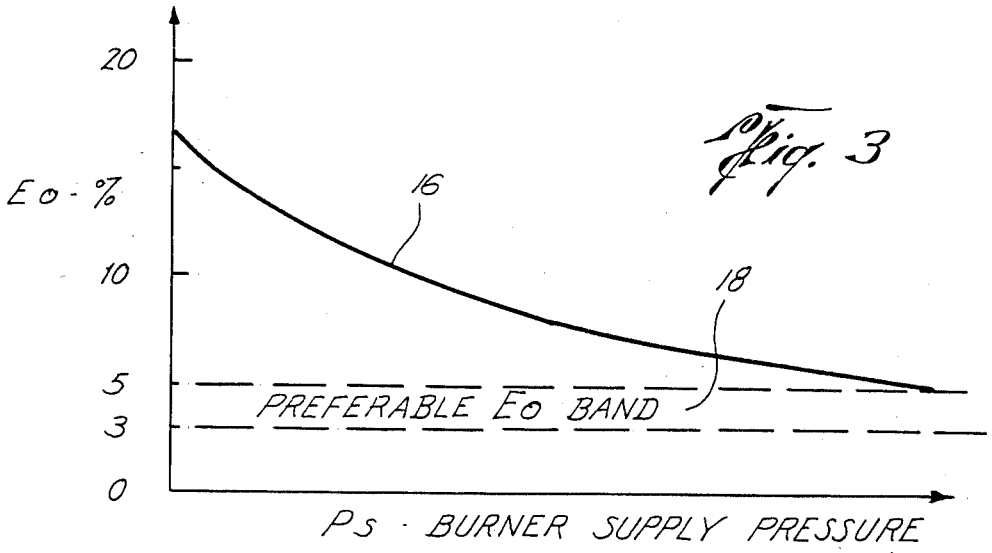
FIG. 3 is a typical graph illustrating the difference in the amount of excess oxygen relative to the burner fuel supply pressure in prior art burners and the present invention.

While the present invention may be used in connection with a burner in various types of uses, for purposes of illustration only, FIG. 1 illustrates a system generally indicated by the reference numeral 10 for heating of fluid in oil and gas production equipment. The process fluid 11 is contained, while being heated, in a vessel 12 through which the process fluid 11 flows or is contained. The heating is accomplished by heat transfer from a fire tube 14 in which the products of combustion of a fuel, such as natural gas, and air, are burned.

Ideally the system should be adjusted so that there is approximately 5% excess oxygen at the highest fuel pressure employed. However, with lower pressures or with a pilot only, the excess oxygen will increase as the burner supply of fuel decreases. The typical results of prior art burners, as illustrated in FIG. 3, in graph 16, provides excess oxygen at most supply pressures which far exceed the desired 5% excess oxygen optimum. The result in the typical prior art burner is that excess fuel gas is burned in order to heat the excess air. The present invention is directed to providing an excess air oxygen intake, as best seen in FIG. 3 as graph 18, which varies from approximately 3% to 5% over the entire range of the burner fuel supply pressure which results in optimum fuel economy with minimum emissions. Another advantage is that the present system stabilizes the combustion which reduces burner flame-out.

The burner 10 includes a housing 20 which is connected to the fire tube 14. The housing 20 includes an atmospheric air inlet 22, preferably including a flame arrestor 24, which is covered by a hood 26 for keeping out debris and/or snow. A baffle 30 separates the housing 20 into a first chamber 32 and a second chamber 34, the first chamber forming a primary air inlet chamber and the second chamber 34 forming a combustion chamber with the fire tube 14. A main burner 36 and a pilot burner 38 each extend through the baffle 30. The main burner 36 includes a metering device such as a venturi 40 and the pilot burner 38 includes a metering device such as a venturi 42. It is to be noted that the metering devices 40 and 42 are positioned in the atmospheric primary air inlet chamber 32. This provides a stable and influctuating air supply for eliminating the problems of irregular burning and flame-out of the pilot when the main burner is not firing and eliminates the flame-out of the pilot and main burner when the main burner is turned on. The barrier 30 isolates the metering devices 40 and 42 from the pressure variations which occur in the combustion chamber 34 and therefore dynamically decouples the combustion process and fire tube/stack acoustics from affecting the air and fuel supply to the burners 36 and 38. The main burner 36 includes a burner tip 44 and the pilot burner 38 includes a burner tip 46. The burner tips 44 and 46 are positioned on the opposite side of the barrier 30 from the metering devices 40 and 42 and thus are positioned in the combustion chamber 34 which includes the fire tube 14. Thus, the combustion of fuel and air at the tips 44 and 46 are isolated from creating pressure pulsations in the primary air supply in the air chamber 32.

Fuel gas is supplied to the main burner venturi by a line 48 (FIG. 1 and FIG. 2) from an on-off valve 50 from a motor valve 49. The motor valve 49 automatically regulates the flow of gas to the main burner 38 in response to the control of a pneumatic thermostat 52 from a line 54. Gas supply pressure is supplied to thermostat 52 through line 56 which also supplied to the burners 36 and 38. Gas for the pilot burner 38 is supplied by a line 58 through a manual on-off valve 60 provided to allow shut-down of the pilot 38 when the system is not in operation or to control the gas when the pilot is being lighted.

The thermostat 52 and motor valve main burner valve 49 may be of either the on-off (snap) type or the throttling type.

In order to insure that some of the secondary air is available in the combustion chamber 34, a passage 64 adjacent the main burner 36 and pilot burner 38 through the barrier 30 is provided. Preferably, an air adjustment plate 62 may be provided about the main burner 36 in the form of a horseshoe plate for allowing variable sealing of the space 64 between the main burner 36 and the barrier 30.

However, in order to regulate the air fuel ratio over the firing range of the burner between 3% to 5% of excess oxygen, secondary air is supplied to the combustion chamber 34 through a variable air controller 70. The variable air controller 70 is positioned between ambient air and the combustion chamber 34 and is preferably positioned between the primary inlet air chamber 32 and the combustion chamber 34 although the controller 70 may receive air in other ways. The controller 70 includes a valve element 72 which is connected to any suitable fuel pressure responsive means 74 for controlling the amount of secondary air supplied to the combustion chamber 34 in response to the fuel pressure. Thus, the pressure responsive means 74 may be connected to line 76 which in turn is connected to fuel line 48.

Figure 4:
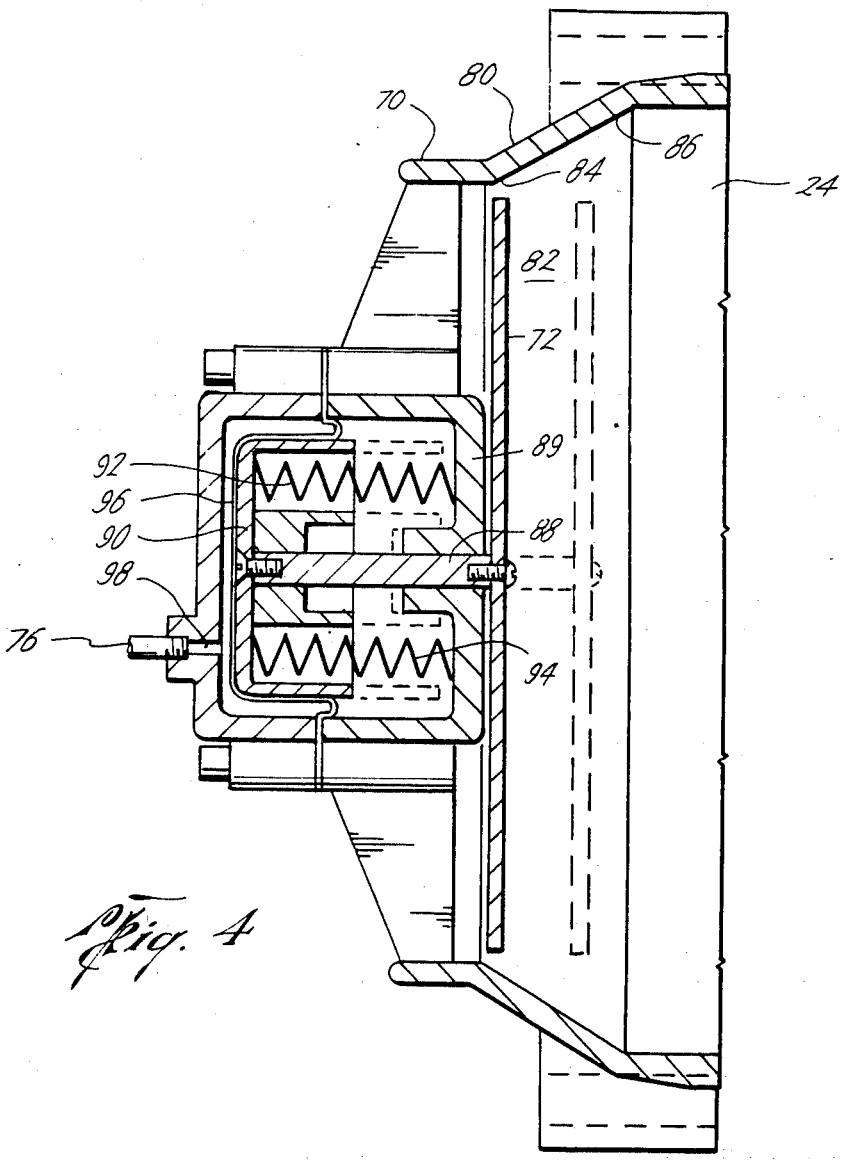
FIG. 4 is an enlarged cross-sectional view of the variable air controller of the present invention used in the secondary air supply.

Referring now to FIG. 4, the preferred embodiment of the air controller 70 is shown, which automatically adjusts and controls the secondary supply of air flow to achieve the desired excess oxygen characteristics 18 shown in FIG. 3. The controller 70 includes a body 80 having a variable size opening 82. That is, the body 80 includes a wall which increases in size from a first end 84 to a second end 86 and is preferably tapered. The valve 72, such as a circular plate, is movable in the opening 82 for changing the area A between the wall 80 and the outer edge of the plate 72. Preferably, there is an air bypass in the plate 72 such as the area $A_o$, at all times which provides a minimum amount of air flow through the controller 70.

The plate 72 is mounted on a movable rod 88 which is slidable through a well 89 of the body 80 and secured to a wall 90. Suitable biasing means such as one or more springs 92 and 94 are provided between the walls 89 and 90 for yieldably urging the plate 72 in a direction for reducing the volume of air flow through the opening 82. Pressure responsive means, such as a diaphragm 96, is provided in the housing 89 and on the wall 90 and connected to the valve 72 for moving the valve 72 in a direction for increasing the volume of air in response to an increase in the pressure of the fuel. The diaphragm 96 is exposed to a port 98 which is connected to the line 76. Therefore, increased pressure fuel acts on the diaphragm 96 to move the valve 82 towards the second end 86 of the tapered body 80 for increasing the annular area and increasing the volume of air. The area A of the valve of the valve opening is varied approximately linearly with the pressurized fuel gas.

In operation, fuel is supplied to the pilot burner 38 from line 56 as previously discussed. The main burner 36 may be operated in an on-off mode of operation where the main burner is either fully on or completely off or in the throttling mode of operation where the main burner continues to fire at all times but the gas fuel pressure is continually and automatically varied as required. In either case, fuel is supplied through line 56 to the valve 49 and to the thermostat 52 which in turn controls the operation of the valve 49 to supply fuel through line 48 to the main burner 36. Primary air for the pilot burner 38 and the main burner 36 is supplied from the primary air inlet chamber 32 and mixes with the gas in the venturis 40 and 42, respectively, and burned in the burner tips 44 and 46, respectively. Additional secondary air for the pilot burner 46 enters the combustion chamber 34 through the opening 64. The adjustment plate 62 provides a minimum area of opening consistent with stable burning of the pilot burner 46 and to provide good lighting of the fuel air mixture at the main burner tip 44 when the main burner 36 is turned on.

When the main burner 36 is turned on, additional secondary air is now required for complete combustion and to achieve the desired 3% to 5% excess oxygen. Therefore, the valve element 72 in the air controller 70 opens and closes in proportion to the fuel gas pressure supplied to the main burner 36 to achieve this desired result by selection of the proper combination of springs 92 and 94 in response to the gas pressure in line 76.

The present system has been found to solve the problems of the prior art. Two primary reasons are (1) the mixture of fuel gas and primary air delivered to the burner tips 44 and 46 by the main 36 and pilot burner 38 is now at all times more oxygen rich and is in need of less secondary oxygen to complete combustion, therefore, the flame is more stable, and (2) the combustion chamber 34 and fire tube 14 have been largely decoupled acoustically from the burners 36 and 38 since the mixing devices 40 and 42 where the fuel gas and primary air mixing occur are located in the chamber 32 which is essentially at atmospheric pressure and cannot support significant acoustical pressure pulsations and is isolated from chamber 34 by the barrier 30. In addition, since the air controller 70 is controlling only the secondary air, a smaller air controller 70 is required which also increases the sensitivity of its control. Therefore, the desired 3% to 5% excess oxygen is now achieved by the controller 70 controlling only a portion of the total air flow required for combustion.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A heating apparatus comprising, a housing having an atmospheric air inlet, a baffle in the housing separating the housing into first and second chambers, said first chamber forming a primary air inlet chamber, and said second chamber forming a combustion chamber, a main burner and a pilot burner extending through the baffle, said main burner and said pilot burner each including a metering device for mixing air and fuel, said metering devices positioned in the air inlet chamber, said main burner and said pilot burner each including a burner tip positioned in the combustion chamber, a variable air controller for controlling secondary air for optimizing the air fuel ratio, said controller including, a valve positioned in a wall of the combustion chamber and adapted to supply ambient air to the combustion chamber, and fuel pressure responsive means connected to said valve and a fuel supply line for said main burner for controlling the amount of secondary ambient air in response to the fuel pressure.

2. The apparatus of claim 1 wherein the metering devices include venturis.

3. The apparatus of claim 1 wherein the valve controls the amount of secondary air linearly relative to the supply of fuel to the main burner.

4. The apparatus of claim 1 wherein said barrier includes means forming an adjustable air opening.

5. The apparatus of claim 1 wherein the valve is positioned in said baffle.

* * * * *